US010935303B2

(12) United States Patent
Lee et al.

(10) Patent No.: US 10,935,303 B2
(45) Date of Patent: Mar. 2, 2021

(54) REFRIGERATOR

(71) Applicant: LG ELECTRONICS INC., Seoul (KR)

(72) Inventors: Sanggyun Lee, Seoul (KR); Dongseok Kim, Seoul (KR); Yongwon Dong, Seoul (KR); Younseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 45 days.

(21) Appl. No.: 16/235,595

(22) Filed: Dec. 28, 2018

(65) Prior Publication Data

US 2019/0301786 A1 Oct. 3, 2019

(30) Foreign Application Priority Data

Apr. 2, 2018 (KR) ..... 10-2018-0038184

(51) Int. Cl.

| | |
|---|---|
| ***F25D 17/08*** | (2006.01) |
| ***F25B 5/02*** | (2006.01) |
| ***F24F 7/06*** | (2006.01) |
| *F25D 17/06* | (2006.01) |
| *F24F 13/06* | (2006.01) |

(52) U.S. Cl.

CPC ..... *F25D 17/08* (2013.01); *F24F 7/06* (2013.01); *F25B 5/02* (2013.01); *F24F 2013/0616* (2013.01); *F25D 17/067* (2013.01); *F25D 2317/063* (2013.01); *F25D 2317/0661* (2013.01); *F25D 2317/0672* (2013.01)

(58) Field of Classification Search

CPC ..... F25D 17/065; F25D 17/08; F25D 17/067; F25D 2317/063; F25D 2317/0661; F25D 2317/0672; F25B 5/02; F24F 2013/0616; F24F 7/06

See application file for complete search history.

(56) References Cited

U.S. PATENT DOCUMENTS 1,391,216 A * 9/1921 Stewart ..... F24F 7/06 454/253

5,735,138 A 4/1998 Park et al.

(Continued)

FOREIGN PATENT DOCUMENTS

CN 102741633 A 10/2012
CN 107178949 A 9/2017

(Continued)

*Primary Examiner* — David J Teitelbaum

(74) *Attorney, Agent, or Firm* — Dentons US LLP

(57) ABSTRACT

A refrigerator includes a first inner case, a second inner case, a third inner case having a larger size than the first and second inner cases, a first evaporator and a first cooling fan disposed inside the first inner case, a second evaporator and a second cooling fan disposed inside the second inner case, a duct in which a first inlet portion communicating with an inside of the first inner case, a second inlet portion communicating with an inside of the second inner case, an outlet portion communicating with the third inner case, a first conduit for guiding, to the outlet portion, cold air blown from the first cooling fan from the first inlet portion, and a second conduit for guiding, to the outlet portion, cold air blown from the second cooling fan from the second inlet portion are formed, and a damper communicating with the outlet portion.

23 Claims, 12 Drawing Sheets

(56) References Cited

U.S. PATENT DOCUMENTS

| | | | | |
|---|---|---|---|---|
| 2008/0014859 | A1* | 1/2008 | Edmisten | F24F 13/084 454/290 |
| 2008/0314054 | A1 | 12/2008 | An et al. | |
| 2018/0224186 | A1* | 8/2018 | Besore | F25D 17/065 |
| 2020/0064048 | A1* | 2/2020 | Liengaard | F25D 11/022 |

FOREIGN PATENT DOCUMENTS

| | | | |
|---|---|---|---|
| EP | 2015009 | A2 | 1/2009 |
| JP | 2017036853 | A | 2/2017 |
| KR | 10-2009-0046251 | A | 11/2009 |
| WO | 2008010633 | A1 | 1/2008 |
| WO | 2018091323 | A1 | 5/2018 |

* cited by examiner

REFRIGERATOR

This application claims priority under 35 U.S.C. 119 and 365 to Korean Patent Application No. 10-2018-0038184, filed on Apr. 2, 2018 in the Korean Intellectual Property Office, the disclosure of which is incorporated herein by reference.

BACKGROUND

1. Field of the Disclosure

The present disclosure relates to a refrigerator, and to a refrigerator having storage chambers greater in number than the number of evaporators.

2. Discussion of the Related Art

A refrigerator is a device for cooling or storing objects to be cooled (hereinafter, referred to as food), at a low temperature such as foods, from spoiling or going sour, and to preserve medicines and cosmetics.

The refrigerator includes a freezing chamber in which food is stored and a freezing cycle apparatus for cooling the freezing chamber.

The freezing cycle apparatus may include a compressor, a condenser, an expansion device and an evaporator, in which refrigerant is circulated.

The refrigerator may include a freezing chamber maintained at a subzero temperature range and a refrigerating chamber maintained at a temperature range above zero, both of which may be cooled by at least one evaporator.

The refrigerator may include a switchable chamber having a temperature range varying according to a user desire, which may be formed independently of the freezing chamber and the refrigerating chamber. In this case, the switchable chamber may operate as a freezing chamber or a refrigerating chamber by user selection or may be maintained in a temperature range different from those of the freezing chamber and the refrigerating chamber.

An example of a refrigerator having a switchable chamber is disclosed in Korean Laid-Open Patent Publication No. 10-2009-0046251 A (published on May 11, 2009). Such a refrigerator includes a first evaporator for cooling a refrigerating chamber, a second evaporator for simultaneously or selectively cooling a freezing chamber and a switchable chamber, a cold air supply device for selectively suppling cold air generated in the second evaporator to the freezing chamber and the switchable chamber, and a first blowing fan for generating blowing force to forcibly circulate the cold air generated in the first evaporator to the freezing chamber.

The cold air supply device of the refrigerator includes a second blowing fan for selectively forcibly circulating the cold air generated in the second evaporator to the freezing chamber and the switchable chamber to generate blowing force and a damper for controlling an amount of cold air of the switchable chamber and the freezing chamber. The damper includes a first damper formed on a rear wall of the switchable chamber to control the amount of cold air in the switchable chamber and a second damper formed on a rear wall of the freezing chamber to control the amount of cold air in the freezing chamber.

SUMMARY

An object of the present disclosure is to provide a refrigerator capable of optimally cooling three storage chambers while minimizing the number of ducts, dampers and evaporators.

To achieve the above objects, there is provided a refrigerator includes a first inner case, a second inner case disposed next to the first inner case, a third inner case having a larger size than the first inner case and the second inner case, a first evaporator and a first cooling fan disposed inside the first inner case, a second evaporator and a second cooling fan disposed inside the second inner case, a duct in which a first inlet portion communicating with an inside of the first inner case, a second inlet portion communicating with an inside of the second inner case, an outlet portion communicating with the third inner case, a first conduit for guiding, to the outlet portion, cold air blown from the first cooling fan from the first inlet portion, and a second conduit for guiding, to the outlet portion, cold air blown from the second cooling fan from the second inlet portion are formed, and a damper communicating with the outlet portion.

The duct may include a first guide and a second guide spaced apart from each other, and a barrier located between the first guide and the second guide and spaced apart from the first guide and the second guide, the first conduit may be formed between one surface of the barrier and the first guide, and the second conduit may be formed between the other surface of the barrier and the second guide.

The barrier may include a left wall spaced apart from the first guide in a horizontal direction and a right wall spaced apart from the second guide in the horizontal direction, and the left wall and the right wall may be connected at an upper end.

The left wall and the right wall progressively move away from each other in the vertical direction toward the bottom.

The barrier may be spaced apart from the outlet portion under the outlet portion in a vertical direction.

One surface of the barrier and the other surface of the barrier may become sloped gradually from the bottom and become steep toward the top.

An upper end of the barrier may be closer to the outlet portion than the first inlet portion and the second inlet portion.

The outlet portion may not overlap the first inlet portion and the second inlet portion in a vertical direction and a horizontal direction.

A left-and-right length of the outlet portion may be greater than that of the first inlet portion and that of the second inlet portion.

A duct communication portion inserted into the outlet portion may be formed in the damper.

The refrigerator may further include an inlet duct including a first inlet and a second inlet for sucking cold air of the third inner case, the first inlet and the second inlet being spaced apart from each other, a first return duct connected to the first inlet to guide cold air of the inlet duct to the first evaporator, and a second return duct connected to the second inlet to guide cold air of the inlet duct to the second evaporator.

The first inlet and the second inlet may be spaced apart from each other in a horizontal direction with at least one of the duct and the damper interposed therebetween.

The inlet duct may further include an inlet communication portion for enabling the first inlet and the second inlet to communicate with each other.

The refrigerator may further include a first discharging duct disposed inside the first inner case to cover the first evaporator, a second discharging duct disposed inside the second inner case to cover the second evaporator, the first inlet portion may be connected to an upper portion of the first discharging duct, and the second inlet portion may be connected to an upper portion of the second discharging duct.

DETAILED DESCRIPTION OF THE PREFERRED EMBODIMENTS

Hereinafter, detailed embodiments of the present disclosure will be described in detail with reference to the accompanying drawings.

Figure 1:
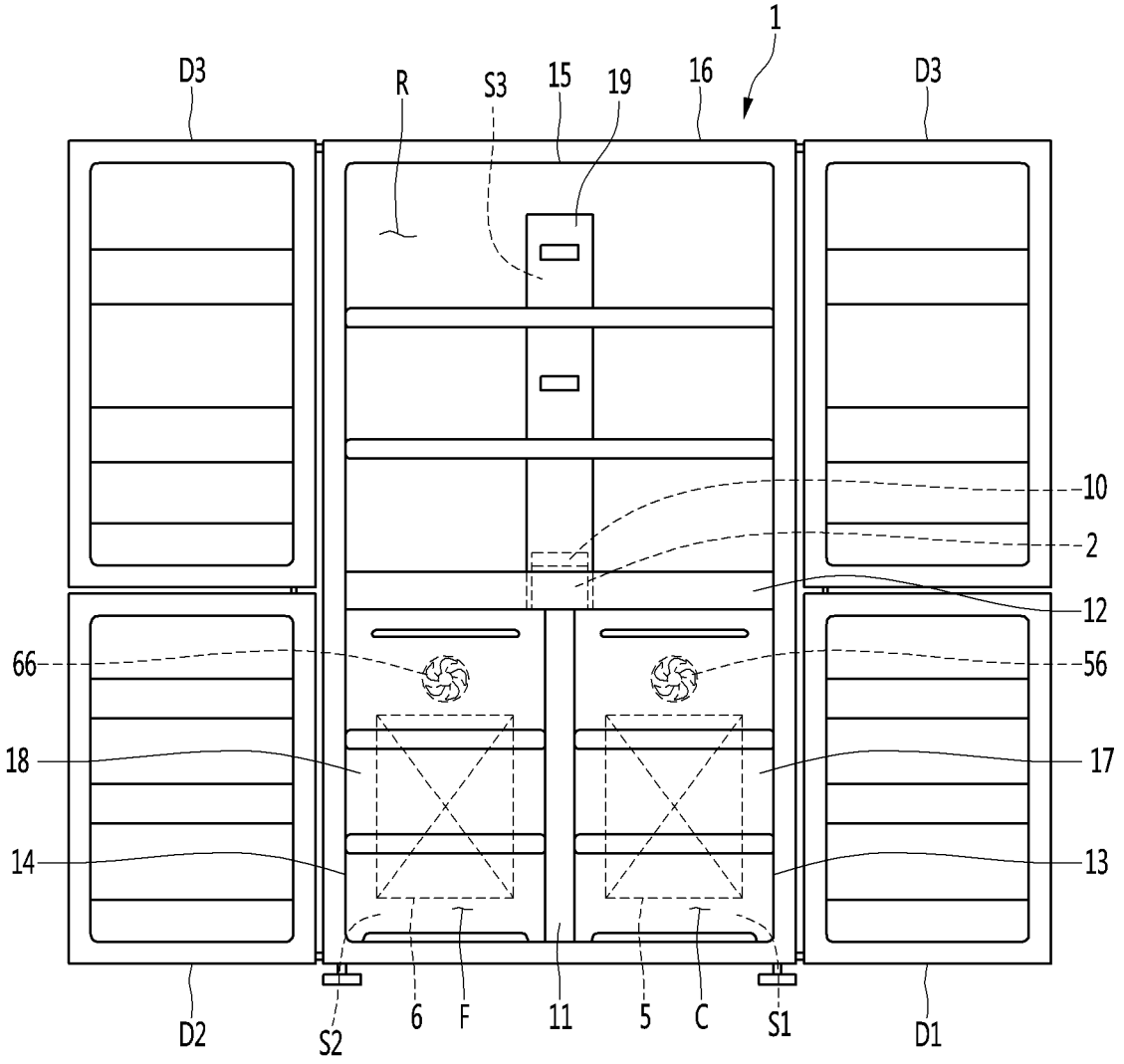
FIG. 1 is a diagram showing an inside of a refrigerator according to an embodiment of the present disclosure.
Figure 2:
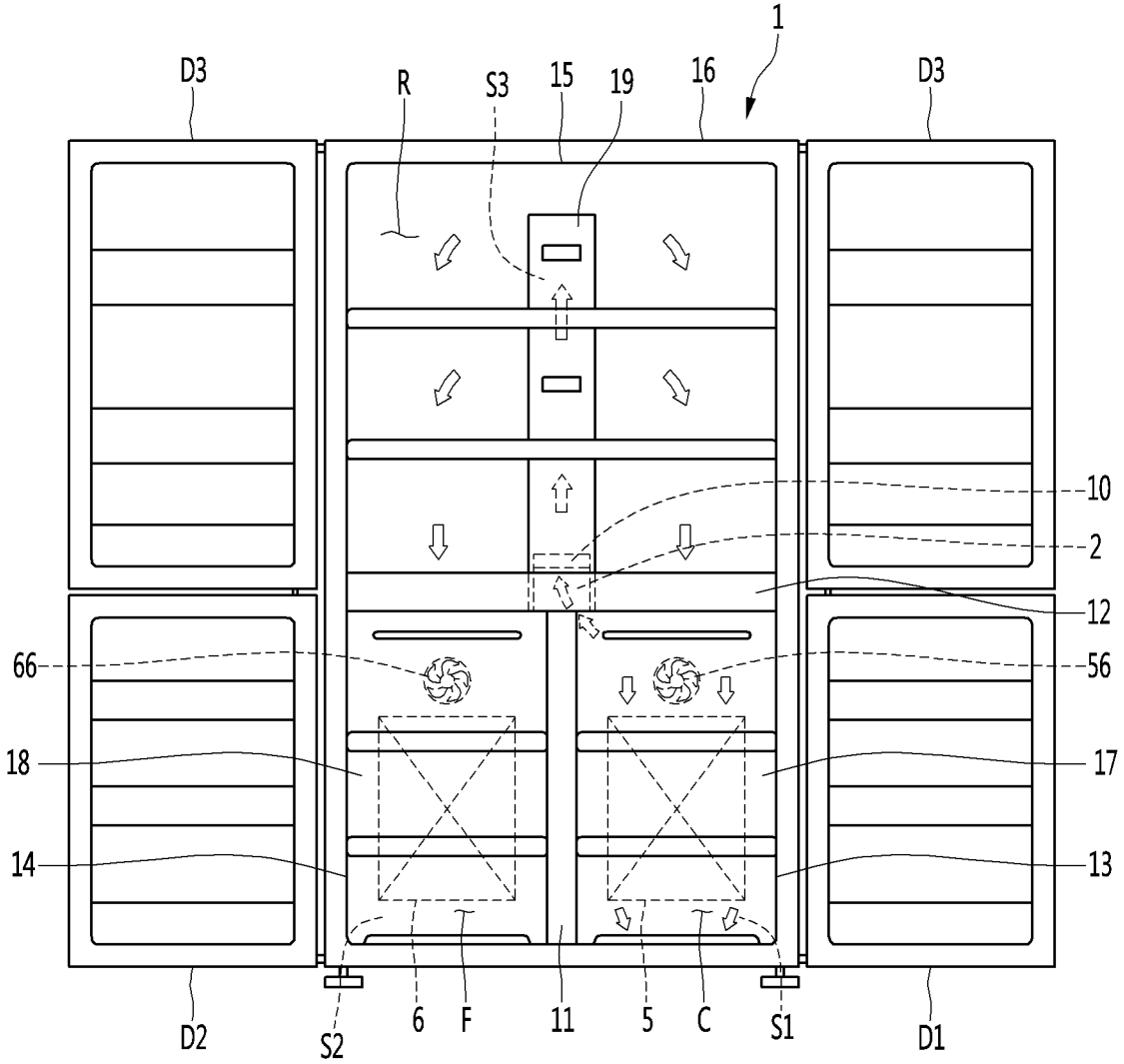
FIG. 2 is a view showing the case where a first cooling fan of the refrigerator according to the embodiment of the present disclosure supplies cold air to a third storage chamber.
Figure 3:
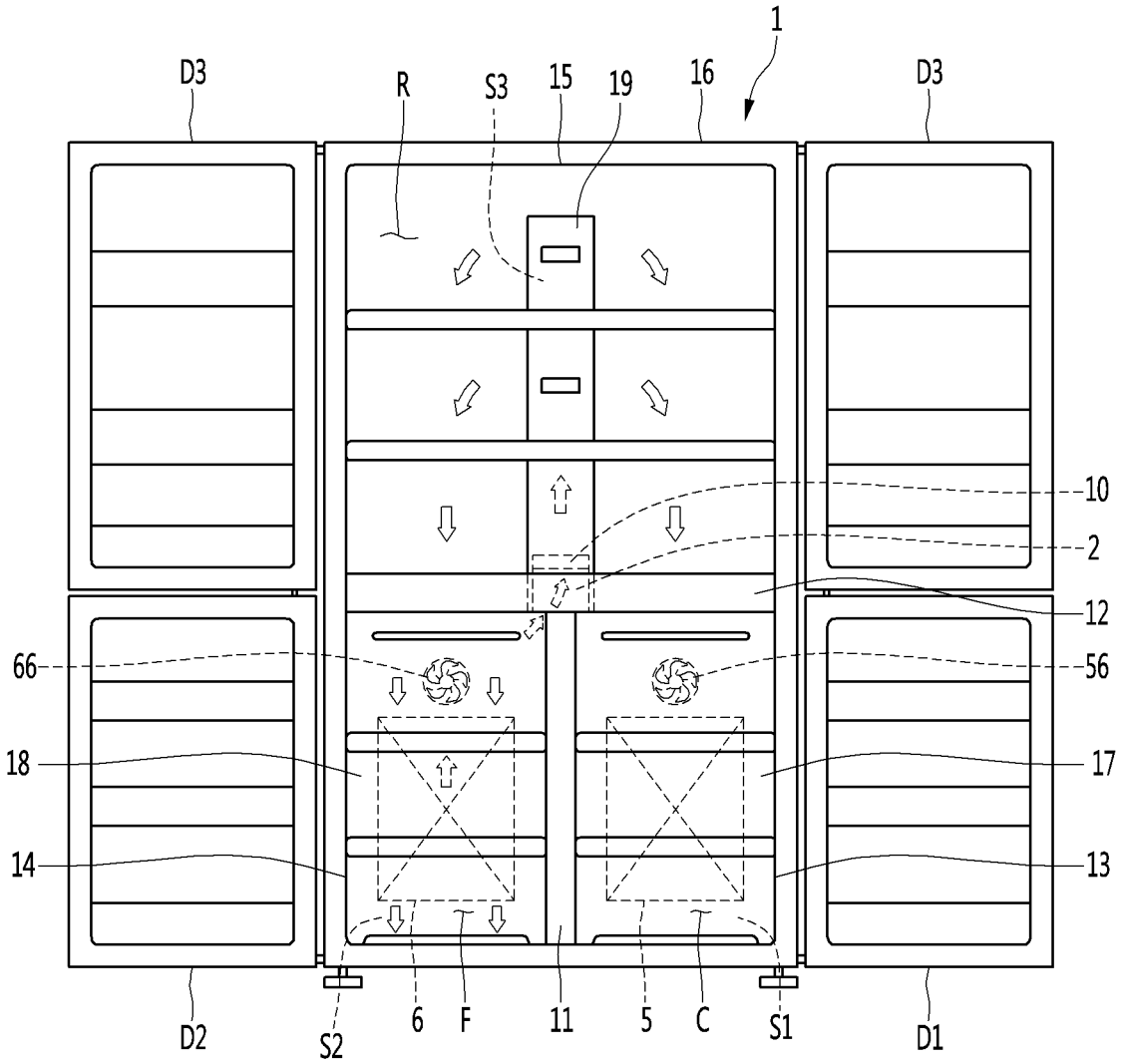
FIG. 3 is a view showing the case where a second cooling fan of the refrigerator according to the embodiment of the present disclosure supplies cold air to the third storage chamber.
Figure 5:
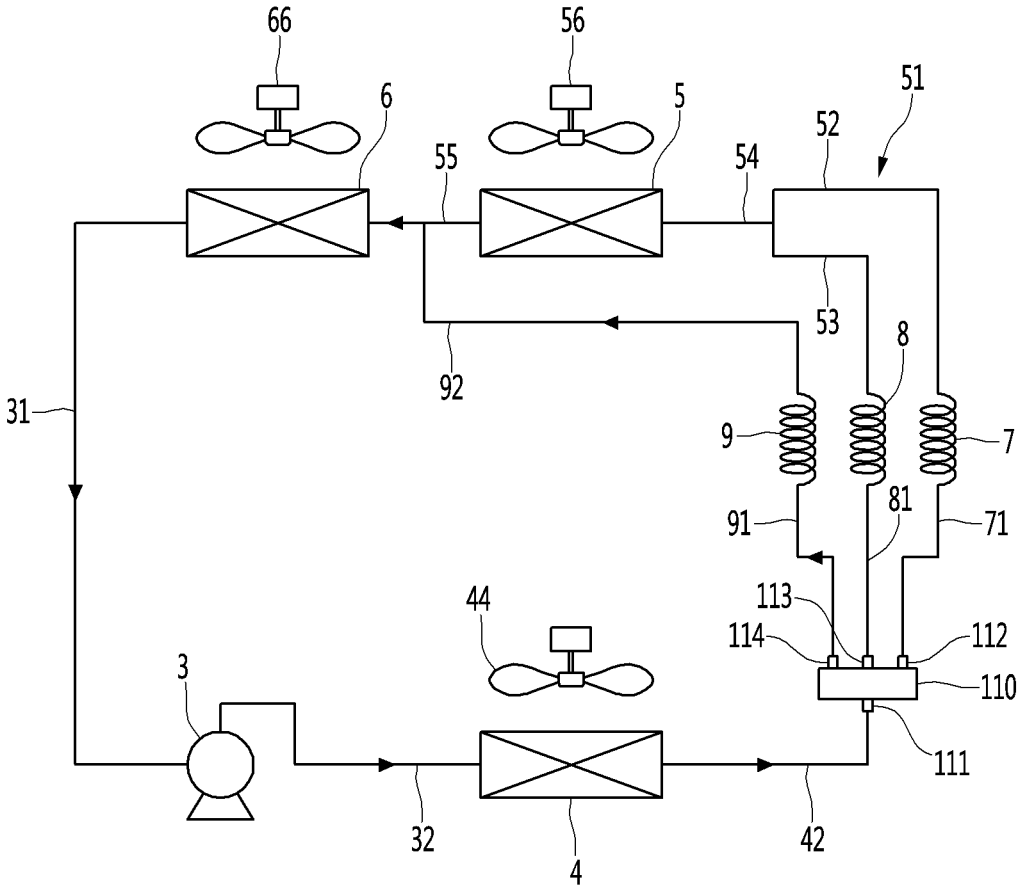
FIG. 5 is a view showing flow of refrigerant when the refrigerator according to the embodiment of the present disclosure is in a bypass mode.
Figure 6:
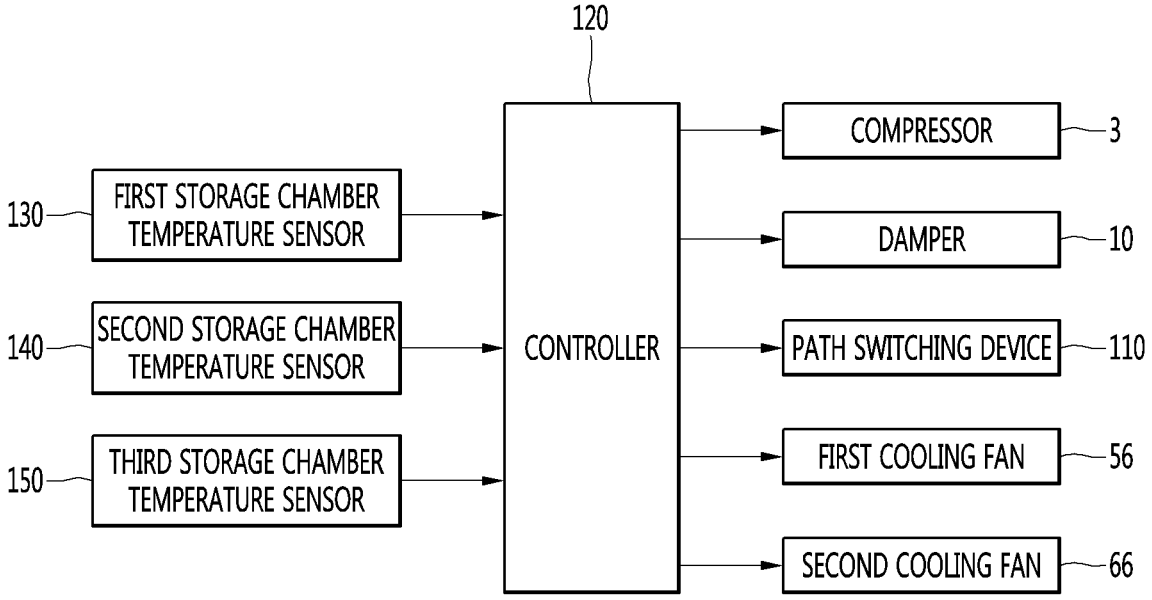
FIG. 6 is a control block diagram showing the refrigerator according to the embodiment of the present disclosure.

FIG. 1 is a diagram showing an inside of a refrigerator according to an embodiment of the present disclosure, FIG. 2 is a view showing the case where a first cooling fan of the refrigerator according to the embodiment of the present disclosure supplies cold air to a third storage chamber, FIG. 3 is a view showing the case where a second cooling fan of the refrigerator according to the embodiment of the present disclosure supplies cold air to a third storage chamber, FIG. is a view showing flow of refrigerant when the refrigerator according to the embodiment of the present disclosure is in a simultaneous supply mode, FIG. 5 is a view showing flow of refrigerant when the refrigerator according to the embodiment of the present disclosure is in a bypass mode, and FIG. 6 is a control block diagram showing the refrigerator according to the embodiment of the present disclosure.

The refrigerator of the present embodiment includes a main body 1, in which a plurality of storage chambers C, F and R are formed, a duct 2 and a damper 10.

The plurality of storage chambers C, F and R may be partitioned by a plurality of barriers 11 and 12. The plurality of storage chambers C, F and R may include a first storage chamber C, a second storage chamber F and a third storage chamber R. The first storage chamber C, the second storage chamber F and the third storage chamber R may be partitioned by the plurality of barriers 11 and 12.

Any one storage chamber among the first storage chamber C, the second storage chamber F and the third storage chamber R may have a larger size than the other storage chambers, and the storage chamber having a relatively larger size among the plurality of storage chambers C, F and R may be located above or below the storage chambers having smaller sizes.

For instance, the third storage chamber R may have a larger size than the other storage chambers F and C and may have a height different from those of the other storage chambers F and C. The first storage chamber C and the second storage chamber F may have smaller sizes than the third storage chamber R. The first storage chamber C and the second storage chamber F may be located on left and right sides of the refrigerator.

The first storage chamber C and the second storage chamber F may be partitioned to the left and right by the vertical barrier 11.

The third storage chamber R may be separated from the first storage chamber C and the second storage chamber F by the horizontal barrier 12 connected to an upper portion or a lower portion of the vertical barrier 11.

Any one storage chamber of the first storage chamber C, the second storage chamber F and the third storage chamber R may be a switchable chamber having a variable temperature range, another storage chamber may be a freezing chamber, and the other storage chamber may be a refrigerating chamber.

The refrigerator may include an operation unit (not shown) for selecting a temperature range of the switchable chamber. A user may operate the operation unit to select the temperature range of the switchable chamber, and the refrigerator may maintain the switchable chamber at the temperature range selected by the user.

The temperature range of the switchable chamber C may be selected by the user to be equal or similar to that of the refrigerating chamber, to be equal to or similar to that of the freezing chamber, or to be a specific temperature range between the temperature range of the refrigerating chamber and the temperature range of the freezing chamber.

Examples of the temperature range of the switchable chamber may include a temperature range when food having a relatively low storage temperature, such as meat, is stored and a temperature range when food having a relatively high storage temperature, such as vegetables, is stored.

The refrigerating chamber may have a larger size than each of the freezing chamber and the switchable chamber. The switchable chamber and the freezing chamber may be formed on the left and right sides of the vertical barrier 11, and the refrigerating chamber may be formed above or below the switchable chamber and the freezing chamber.

The third storage chamber R having a largest size may be a refrigerating chamber, the first storage chamber C may be a switchable chamber, and the second storage chamber F may be a freezing chamber.

The refrigerator may cool the plurality of storage chambers C, F and R by a freezing cycle device, which includes a compressor 3, a condenser 4, a plurality of evaporators 5 and 6, and at least one capillary tube 7, 8 or 9.

In the refrigerator, the number of evaporators 5 and 6 may be less than the number of storage chambers C, F and R. In this case, the evaporators 5 and 6 may be disposed near the storage chambers C and F having relatively low temperature ranges, and the storage chamber R having a high temperature range may be cooled by air blown by a cooling fan.

The evaporators 5 and 6 are disposed closer to the storage chambers C and F having smaller sizes and the storage chamber R having a larger size may be cooled by air blown by the cooling fan.

The main body 1 may include a first inner case 13 having the first storage chamber C formed therein, a second inner case 14 disposed next to the first inner case 13 and having the second storage chamber F formed therein, and a third inner case 15 having a larger size than the first inner case 13 and the second inner case 14 and having the third storage chamber R formed therein. The main body 1 may include an outer case 16 forming an appearance of the refrigerator. The outer case 16 may be composed of a combination of a plurality of members, and the first inner case 13, the second inner case 14 and the third inner case 15 may be located inside the outer case 16.

An insulator may be filled between the outer case 16 and the first inner case 13, between the outer case 16 and the second inner case 14 and between the outer case 16 and the third inner case 15. The insulator may be filled between the first inner case 13 and the second inner case 14. The insulator may be filled between the third inner case 15 and the first inner case 13 and between the third inner case 15 and the second inner case 14.

A first evaporator 5 and a first cooling fan 56 may be disposed inside the first inner case 13. A first discharging duct 17 for covering the first evaporator 5 may be disposed inside the first inner case 13. The first discharging duct 17 may divide the inside of the first inner case 13 into a first heat exchange chamber S1, in which the first evaporator and the first cooling fan 56 are located, and a first storage chamber C. The main body 1 may be connected with a first storage chamber door D1 for opening or closing the first storage chamber C.

A second evaporator 6 and a second cooling fan 66 may be disposed inside the second inner case 14. A second discharging duct 18 for covering the second evaporator 6 may be disposed inside the second inner case 14. The second discharging duct 18 may divide the inside of the second inner case 14 into a second heat exchange chamber S2, in which the second evaporator 6 and the second cooling fan 66 are located, and a second storage chamber F. The main body 1 may be connected with a second storage chamber door D2 for opening or closing the second storage chamber F.

A third discharging duct 19 for discharging cold air passing through the damper 10 to the third storage chamber R may be disposed inside the third inner case 15. The third discharging duct 19 may divide the inside of the third inner case 15 into a path, through which air passing through the damper 10 passes, and the third storage chamber R. The damper 10 may be disposed in a path S3 formed by the third discharging duct 19. An evaporator or a cooling fan may not be disposed inside the third inner case 15. In this case, the effective volume of the third storage chamber R may be maximized. The main body 1 may be connected with a third storage chamber door D3 for opening or closing the third storage chamber R.

The first inner case 13, the second inner case 14 and the third inner case 15 communicate with one another through the duct 2.

The duct 2 may be disposed at a position where the vertical barrier 11 and the horizontal barrier 12 cross each other.

The compressor 3 compresses refrigerant. The compressor 3 may be connected to a compressor suction path 31 and a compressor discharging path 32, and the compressor 3 may suck and compress the refrigerant of the compressor suction path 31 and then discharge the refrigerant to the compressor discharging path 32.

The condenser 4 condenses the refrigerant compressed in the compressor 3 and may be connected with the compressor discharging path 32. In addition, the condenser 4 may be connected with a condenser discharging path 42. The refrigerant of the compressor discharging path 32 may flow to the condenser 4 to be condensed while passing through the condenser 4, and the refrigerant may be discharged to the condenser discharging path 42. The refrigerator may further include a condensing fan 44 for blowing air to the condenser 4. The condensing fan 44 may blow outside air of the refrigerator to the condenser 4.

The plurality of evaporators 5 and 6 may include the first evaporator 5 for cooling the first storage chamber C and the second evaporator 6 for cooling the freezing chamber F.

The first evaporator 5 and the second evaporator 6 may be connected in series. The first evaporator 5 and the first evaporator 6 may be connected through an evaporator connection path 55.

Refrigerant may pass through any one of the first evaporator 5 and the second evaporator 6, pass through the evaporator connection path 55 and pass through the other of the first evaporator 5 and the second evaporator 6.

The first evaporator 5 may be located at an upstream side of the second evaporator 6 in a refrigerant flow direction. In this case, the refrigerant may sequentially pass through the first evaporator 5, the evaporator connection path 55, and then pass through the second evaporator 6.

Meanwhile, the evaporator connection path 55 may be connected with a bypass path 92, through which the refrigerant pass in order to bypass the first evaporator 5. The refrigerant may flow into the bypass path 92 to bypass the first evaporator 5 and then flow into the evaporator connection path 55 to pass through the second evaporator 6.

The plurality of capillary tubes 7, 8 and 9 may include a pair of main capillary tubes 7 and 8 connected to the first evaporator 5 and a bypass capillary tube 9 connected to the evaporator connection path 55. The bypass capillary tube 9 may be a portion of the bypass path 92.

The first evaporator 5 may be connected to the pair of main capillary tubes 7 and 8 through a joint path 51.

The joint path 51 may include a first path 52 connected to the first capillary tube 7 of the pair of main capillary tubes 7 and 8, a second path 53 connected to the second capillary tube 8 of the pair of main capillary tubes 7 and 8, and a common path 54 connected with the first path and the second path 53 and connected with the first evaporator 5.

The refrigerator may further include a first cooling fan 56 for enabling the cold air of the first storage chamber C to flow to the first evaporator 5 and then blowing the cold air to the first storage chamber C and the duct 2.

The second evaporator 6 may be connected to the compressor 3 and the compressor suction path 31. Since the second evaporator 6 is connected to the first evaporator 5 in series, heat exchange with the refrigerant evaporated in the second evaporator 6 may be performed.

The refrigerator may further include a second cooling fan 66 for enabling the cold air of the freezing chamber F to flow to the second evaporator 6 and then blowing the cold air to the freezing chamber F and the duct 2.

The refrigerator may include a path switching device 110 for switching the path of the refrigerant condensed in the condenser 4.

The pair of main capillary tubes 7 and 8 may be connected to the path switching device 110.

The first capillary tube 7 of the pair of main capillary tubes 7 and 8 may be connected to the path switching device 110 through a first inlet path 71, and may be connected to the first evaporator 5 through the joint path 51. The first capillary tube 7 may be connected to the joint path 51 and, more particularly, to the first path 52.

The second capillary tube 8 of the pair of main capillary tubes 7 and 8 may be connected to the path switching device 110 through a second inlet path 81, and may be connected to the first evaporator 5 through the joint path 51. The second capillary tube 8 may be connected to the joint path 51 and, more particularly, to the second path 53.

The pair of main capillary tubes 7 and 8 may have the same capacity.

The bypass capillary tube 9 may connect the path switching device 110 with the evaporator connection path 55. The bypass capillary tube 9 may decompress the refrigerant bypassing the first evaporator 5 after being condensed in the condenser 4. The bypass capillary tube 9 may be connected to the path switching device 110 through a third inlet path 91. The bypass capillary tube 9 may be connected to the evaporator connection path 55 through an outlet path 92.

The path switching device 110 may be connected to the condenser discharging path 42, the pair of main capillary tubes 7 and 8 and the bypass capillary tube 9. The path switching device 110 may guide the refrigerant flowing in the condenser discharging path 42 to pair of main capillary tubes 7 and 8 and the bypass capillary tube 9.

The path switching device 110 may be composed of a single valve or a combination of a plurality of valves. The path switching device 110 of the present embodiment may include one four-way valve. The path switching device 110 may include one inlet port 111 and three outlet ports 112, 113 and 114.

The path switching device 110 may include an inlet port 111 connected with the condenser discharging path 42.

In the path switching device 110, a first outlet port 112 connected to any one of the pair of capillary tubes 7 and 8, a second outlet port 113 connected to the other of the pair of capillary tubes 7 and 8, a third output port 114 connected to the bypass capillary tube 9 may be formed.

The refrigerator of the present embodiment may be a dual capillary-serial bypass cycle in which the first evaporator 5 and the second evaporator 6 may be connected in series, the refrigerant may bypass the first evaporator 5 to flow to the second evaporator 6, and the dual capillaries 7 and 8 may supply a large amount of refrigerant to the first evaporator 5.

The refrigerator of the present embodiment may control the temperatures of the three storage chambers C, F and R using one compressor 3, two evaporators 5 and 6, three capillary tubes 7, 8 and 9, two fans 56 and 66, the duct 2 and the damper 10.

The refrigerator may include a controller 120 for controlling the compressor 3, the damper 10 and the path switching device 110. The controller may be an electronic circuit including a microprocessor, a logical electronic circuit, or a custom integrated circuit. The refrigerator may further include a first temperature sensor 130 for sensing the temperature of the first storage chamber, a second temperature sensor 140 for sensing the temperature of the second storage chamber and a third temperature sensor 150 for sensing the temperature of the third storage chamber.

The controller 120 may control the damper 10 according to the temperature of the third storage chamber sensed by the third temperature sensor 150.

The controller 120 may open the damper 10 if the temperature of the third storage chamber is dissatisfied, and close the damper 10 if the temperature of the third storage chamber is satisfied.

Satisfaction of the temperature of the third storage chamber may correspond to the case where the temperature of the third storage chamber decreases to a lower-limit temperature (target temperature−1° C.) of a target temperature of the third storage chamber. The controller 120 may close the damper 10 when the temperature of the third storage chamber decreases to the lower-limit temperature of the target temperature of the third storage chamber.

Dissatisfaction of the temperature of the third storage chamber may correspond to the case where the temperature of the third storage chamber increases to an upper-limit temperature (target temperature+1° C.) of the target temperature of the third storage chamber. The controller 120 may open the damper 10 when the temperature of the third storage chamber increases to the upper-limit temperature of the target temperature of the third storage chamber.

The controller 120 may control rotational speeds of the first cooling fan 56 and the second cooling fan 66 according to the values sensed by the first temperature sensor 130, the second temperature sensor 140 and the third temperature sensor 150. The rotational speed of each of the first cooling fan 56 and the second cooling fan 66 may be changed to a low speed mode, a middle speed mode and a high speed mode.

When the temperature of the third storage chamber is dissatisfied, the controller 120 may open the damper 10 and drive at least one of the first cooling fan 56 and the second cooling fan 66, as shown in FIGS. 2 and 3.

As shown in FIG. 2, when the first cooling fan 56 is driven and the damper 10 is opened, the first cooling fan 56 may enable the cold air of the first storage chamber C to flow to the first evaporator 5 to cool the cold air by the first evaporator 5. Some of the cold air cooled by the first evaporator 5 may be discharged to the first storage chamber C through the first discharging duct 17, and the remaining air may be discharged to the third storage chamber R through the duct 2, the damper 10 and the third discharging duct 19.

As shown in FIG. 3, when the second cooling fan 66 is driven and the damper 10 is opened, the second cooling fan 66 may enable the cold air of the freezing chamber F to flow to the second evaporator 6 to cool the cold air by the second evaporator 6. Some of the cold air cooled by the second evaporator 6 may be discharged to the second storage chamber F through the second discharging duct 18, and the remaining air may be discharged to the third storage chamber R through the duct 2, the damper 10 and the third discharging duct 19.

Figure 4:
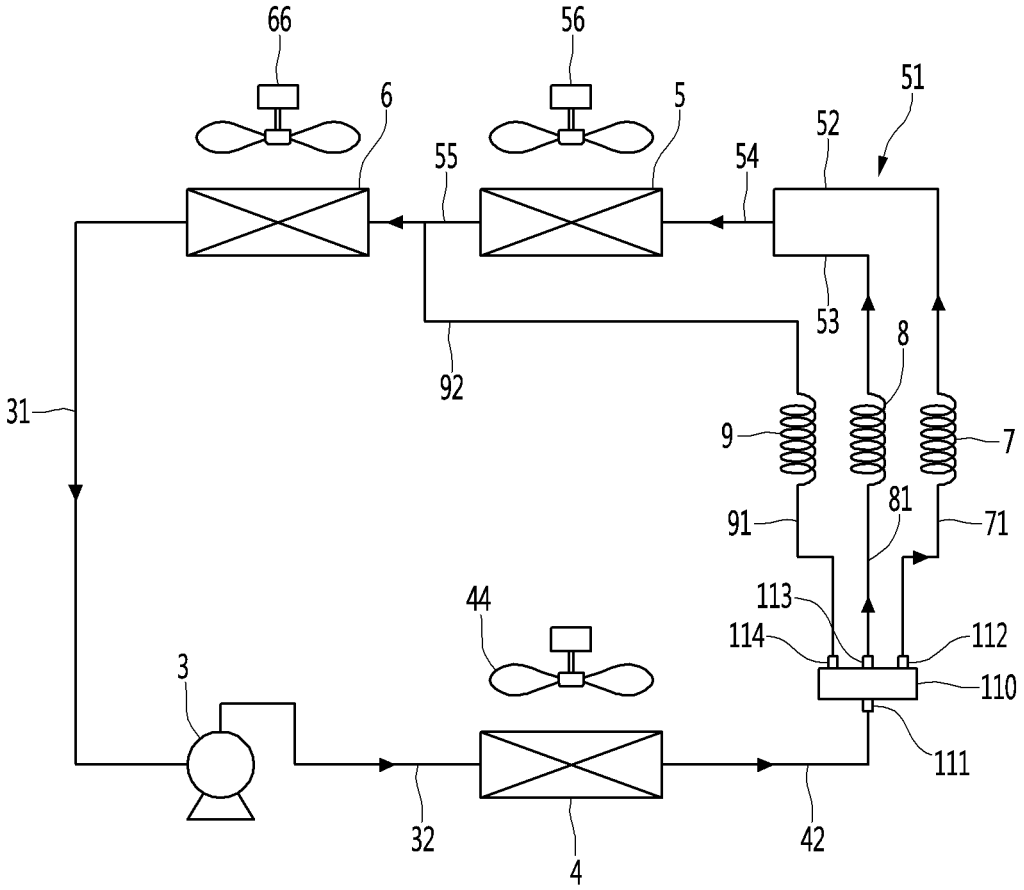
FIG. 4 is a view showing flow of refrigerant when the refrigerator according to the embodiment of the present disclosure is in a simultaneous supply mode.

Meanwhile, the controller 120 may control the path switching device 110 to one of the plurality of modes, as shown in FIGS. 4 and 5, according to the values sensed by the first temperature sensor 130 and the second temperature sensor 140.

The plurality of modes may include a simultaneous supply mode in which the path switching mechanism 110 guides refrigerant to the pair of main capillary tubes 7 and 8.

The simultaneous supply mode may be a mode in which refrigerant is not guided to the bypass capillary tube 9 and is guided to the pair of main capillary tubes 7 and 8, as shown in FIG. 4.

When the path switching device 110 is in the simultaneous supply mode and the compressor 3 is driven, the compressor 3 may compress and discharge refrigerant, and the refrigerant compressed in the compressor 3 may pass through the condenser 4 and then pass through the path switching device 110, thereby being distributed to the pair of main capillary tubes 7 and 8 by the path switching device 110. In this case, the refrigerant may pass through the pair of main capillary tubes 7 and 8, pass through the first evaporator 5, and then pass through the second evaporator 6, and eventually being sucked into the compressor 3.

Meanwhile, the plurality of modes may further include a bypass mode in which the path switching device 110 guides refrigerant to the bypass capillary tube 9. The bypass mode may be a mode in which refrigerant is not guided to the pair of main capillary tubes 7 and 8 and is guided to the bypass capillary tube 9, as shown in FIG. 5.

When the path switching device 110 is in the bypass mode and the compressor 3 is driven, the compressor 3 may compress and discharge refrigerant, and the refrigerant compressed in the compressor 3 may pass through the condenser 4 and then pass through the path switching device 110, thereby being guided to the bypass capillary tube 9 by the path switching device 110. In this case, the refrigerant may pass through the by capillary tubes 9, bypass the the first evaporator 5, and pass through the second evaporator 6, and eventually being sucked into the compressor 3.

is satisfied and the temperature of the second storage chamber increases to the upper temperature (target temperature+1° C.) of the target temperature of the second storage chamber.

In the bypass mode, since the refrigerant bypasses the first evaporator 5 and flows into the second evaporator 6, it is possible to rapidly solve the load of the second storage chamber F.

The controller 120 may control the first cooling fan 56 and the second cooling fan 66. The controller 120 may change the speeds of the first cooling fan 56 and the second cooling fan 66 according to the values sensed by the first temperature sensor 130, the second temperature sensor 140 and the third temperature sensor 150. The speed of each of the first cooling fan 56 and the second cooling fan 66 may be changed to a low speed L, a middle speed M and a high speed H.

The controller 120 may differently control the rotational speed, i.e, revolutions per minute (rpm) of each of the first cooling fan 56 and the second cooling fan 66 according to the target temperature of the first storage chamber C.

Table 1 shows a method of controlling the first cooling fan 56, the second cooling fan 66, the path switching device 110 and the damper 10 according to satisfaction/dissatisfaction of the third storage chamber temperature, satisfaction/dissatisfaction of the first storage chamber temperature and satisfaction/dissatisfaction of the second storage chamber temperature when the target temperature of the first storage chamber C exceeds the set temperature.

TABLE 1

| Example | Third storage chamber temperate | First storage chamber temperature | Second storage chamber temperature | Second cooling fan wind speed | First cooling fan wind speed | Path switching device mode | Damper mode |
|---|---|---|---|---|---|---|---|
| First example | dissatis-faction | dissatis-faction | dissatis-faction | L | H | Serial mode | open |
| Second example | dissatis-faction | satisfac-tion | satisfac-tion | H | L | Close | open |
| Third example | dissatis-faction | dissatis-faction | satisfac-tion | L | H | Serial mode | open |
| Fourth example | dissatis-faction | satisfac-tion | dissatis-faction | H | L | Bypass mode | open |
| Fifth example | satisfac-tion | satisfac-tion | dissatis-faction | M | stop | Bypass mode | close |
| Sixth example | satisfac-tion | dissatis-faction | satisfac-tion | stop | M | Serial mode | close |
| Seventh example | satisfac-tion | dissatis-faction | dissatis-faction | M | M | Serial mode | close |
| Eighth example | satisfac-tion | satisfac-tion | satisfac-tion | stop | stop | close | close |

The bypass mode may be performed when the temperature of the first storage chamber is satisfied and the temperature of the second storage chamber is dissatisfied.

Satisfaction of the temperature of the second storage chamber may correspond to the case where the temperature of the second storage chamber decreases to a lower-limit temperature (target temperature−1° C.) of a target temperature of the second storage chamber. Dissatisfaction of the temperature of the second storage chamber may correspond to the case where the temperature of the second storage chamber increases to an upper-limit temperature (target temperature+1° C.) of the target temperature of the second storage chamber. The controller 120 may perform the bypass mode when the temperature of the first switchable chamber The controller 120 may differently control the rotational speed of each of the first cooling fan 56 and the second cooling fan 66 when the target temperature of the first storage chamber C exceeds the set temperature (e.g., −13° C.) and a specific condition is satisfied.

Here, the set temperature may be a temperature higher than a maximum target temperature (e.g., −16° C.) among the target temperatures (−16° C. to −24° C.) of the second storage chamber F. The specific condition may be the case where the temperature of the third storage chamber is dissatisfied when the target temperature of the first storage chamber C exceeding the set temperature (e.g., −13° C.) is selected.

In the first to fourth examples of Table 1, the target temperature of the first storage chamber C exceeds the set temperature (e.g., −13° C.) and the temperature of the third storage chamber is dissatisfied. In this case, the controller 120 may open the damper 10 regardless of satisfaction/dissatisfaction of the temperature of the first storage chamber and satisfaction/dissatisfaction of the temperature of the second storage chamber. In addition, the controller 120 may drive both the first cooling fan 56 and the second cooling fan 66 regardless of satisfaction/dissatisfaction of the temperature of the first storage chamber and satisfaction/dissatisfaction of the temperature of the second storage chamber, and may differently control the rotational speed of each of the first cooling fan 56 and the second cooling fan 66.

The case where the target temperature of the first storage chamber C exceeds the set temperature (e.g., −13° C.) and the temperature of the third storage chamber is dissatisfied (that is, the first to fourth examples of Table 1) corresponds to the case where the temperature of the third storage chamber is dissatisfied when the user sets the target temperature of the first storage chamber C relatively high. In this case, the controller 120 may cool the second storage chamber F prior to the first storage chamber C while the first storage chamber C and the second storage chamber F cool the third storage chamber R.

First, the first example will be described in detail. The controller 120 may control the path switching device 110 to the serial mode and rotate the first cooling fan 56 at a higher rotational speed than the second cooling fan 66, when the target temperature of the first storage chamber C exceeds the set temperature (e.g., −13° C.), the temperature of the third storage chamber is dissatisfied, the temperature of the first storage chamber is dissatisfied and the temperature of the second storage chamber is dissatisfied like the first example of Table 1. The controller 120 may rotate the first cooling fan 56 at the high speed H, and rotate the second cooling fan 66 at the low speed L.

If the path switching device 110 is in the serial mode, the path switching device 110 may guide refrigerant to the first storage chamber evaporator 5, the refrigerant may pass through the first storage chamber evaporator 5 and then pass through the second storage chamber evaporator 6, and the refrigerant may be sucked into the compressor 3 after cooling both the first storage chamber C and the second storage chamber F.

The first cooling fan 56 rotates at the high speed H such that the cold air of the first storage chamber C flows to the first storage chamber evaporator 5, and the first cooling fan 56 may blow the cold air exchanging heat with the first storage chamber evaporator 5 to the first storage chamber C and the third storage chamber R.

Meanwhile, the second cooling fan 66 rotates at the low speed L such that the cold air of the second storage chamber F flows to the second storage chamber evaporator 6, and the second cooling fan 66 may blow the cold air exchanging heat with the second storage chamber evaporator 6 to the second storage chamber F and the third storage chamber R, and the cold air of the second storage chamber F may be used to cool the third storage chamber R.

In the first example, the refrigerator may simultaneously cool the third storage chamber R, the first storage chamber C and the second storage chamber F. In addition, since the first cooling fan 56 rotates at a higher speed than the second cooling fan 66, cold air exchanging heat with the first storage chamber evaporator 5 may mainly flow into the third storage chamber R from the first storage chamber C, and the third storage chamber R and the first storage chamber C may be rapidly cooled.

An example in which the temperature of the third storage chamber, the temperature of the first storage chamber and the temperature of the second storage chamber are all dissatisfied may include a case where the power of the refrigerator is switched from OFF to ON, such as a case where the refrigerator starts up. In this case, the refrigerator may rapidly cool the third storage chamber R and the first storage chamber C prior to the second storage chamber F.

Hereinafter, the second example will be described in detail.

The controller 120 may close the path switching device 110 and rotate the second cooling fan 66 at a higher speed than the first cooling fan 56, when the target temperature of the first storage chamber C exceeds the set temperature (e.g., −13° C.), the temperature of a third storage chamber is dissatisfied, the temperature of the first storage chamber is satisfied and the temperature of the second storage chamber is satisfied like the second example of Table 1. The controller 120 may rotate the second cooling fan 66 at the high speed H, and rotate the first cooling fan 56 at the low speed L.

If the path switching device 110 is in a close mode, the compressor 3 may be in an OFF state and the path switching device 110 may not guide refrigerant to the first storage chamber evaporator 5 and the second storage chamber evaporator 6.

The first cooling fan 56 may rotate at the low speed L such that the cold air of the first storage chamber C flows to the first storage chamber evaporator 5, the first cooling fan 56 may blow the cold air exchanging heat with the first storage chamber evaporator 5 to the first storage chamber C and the third storage chamber R, and the cold air of the first storage chamber C may be used to cool the third storage chamber R.

Meanwhile, the second cooling fan 66 may rotate at the high speed H, such that the cold air of the second storage chamber F flows to the second storage chamber evaporator 6, and the second cooling fan 66 may blow the cold air exchanging heat with the second storage chamber evaporator 6 to the second storage chamber F and the third storage chamber R, and the cold air of the second storage chamber F may be used to cool the third storage chamber R.

In the second example, the refrigerator may cool the third storage chamber R using the cold air of the first storage chamber C and the cold air of the second storage chamber F. Since the second cooling fan 66 rotates at a higher speed than the first cooling fan 56, the cold air of the second storage chamber F may mainly flow into the third storage chamber R.

The cold air of the second storage chamber F is the colder air than the cold air of the first storage chamber C and the colder air of the second storage chamber F may mainly flow into the third storage chamber R, and the third storage chamber R may be more rapidly cooled as compared to the case where the cold air of the first storage chamber C flows into the third storage chamber R. Meanwhile, the amount of cold air supplied by the first storage chamber C is less than the amount of cold air supplied by the second storage chamber F, and rapid rise in temperature of the first storage chamber may be minimized.

Hereinafter, the third example will be described.

The controller 120 may control the path switching device 110 to the serial mode and rotate the first cooling fan 56 at a higher speed than the second cooling fan 66, when the target temperature of the first storage chamber C exceeds the set temperature, the temperature of a third storage chamber is dissatisfied, the temperature of the first storage chamber is dissatisfied and the temperature of the second storage chamber is satisfied like the third example of Table 1. The controller 120 may rotate the first cooling fan 56 at the high speed H, and rotate the second cooling fan 66 at the low speed L.

The third example is equal to the first example regarding the first cooling fan 56, the second cooling fan 66, the path switching device 110 and the damper 10. In this case, since the first cooling fan 56 rotates at a higher speed than the second cooling fan 66, cold air exchanging heat with the first storage chamber evaporator 5 may mainly flow into the third storage chamber R, and the third storage chamber R and the first storage chamber C may be rapidly cooled.

Hereinafter, the fourth example will be described.

The controller 120 may control the path switching device 110 to the bypass mode and rotate the second cooling fan 66 at a higher speed than the first cooling fan 56, when the target temperature of the first storage chamber C exceeds the set temperature, the temperature of a third storage chamber is dissatisfied, the temperature of the first storage chamber is satisfied and the temperature of the second storage chamber is dissatisfied like the fourth example of Table 1. The controller 120 may rotate the second cooling fan 66 at the high speed H, and rotate the first cooling fan 56 at the low speed L.

When the path switching device 110 is in the bypass mode, the path switching device 110 may not guide refrigerant to the first storage chamber evaporator 5 and may guide refrigerant to the second storage chamber evaporator 6, and the refrigerant may be sucked into the compressor 3 after bypassing the first storage chamber evaporator 5 and passing through the second storage chamber evaporator 6.

The first cooling fan 56 rotates at the low speed L such that the cold air of the first storage chamber C flows to the first storage chamber evaporator 5, the first cooling fan 56 may blow the cold air exchanging heat with the first storage chamber evaporator 5 to the first storage chamber C and the third storage chamber R, and the cold air of the first storage chamber C may be used to cool the third storage chamber R.

Meanwhile, the second cooling fan 66 rotates at the high speed H such that the cold air of the second storage chamber F flows to the second storage chamber evaporator 6, and the second cooling fan 66 may blow the cold air exchanging heat with the second storage chamber evaporator 6 to the second storage chamber F and the third storage chamber R, and the cold air of the second storage chamber F may be used to cool the third storage chamber R.

In the fourth example, like the second example, the refrigerator may cool the third storage chamber R using the cold air the first storage chamber C and the cold air of the second storage chamber F. In addition, since the second cooling fan 66 rotates at a higher speed than the first cooling fan 56, the cold air of the second storage chamber F may mainly flow into the third storage chamber R.

The cold air of the second storage chamber F may mainly flow into the third storage chamber R, like the second example, and the third storage chamber R may be more rapidly cooled as compared to the case where the cold air of the first storage chamber C flows into the third storage chamber. Meanwhile, the amount of cold air supplied by the first storage chamber C is less than the amount of cold air supplied by the second storage chamber F, and rapid rise in temperature of first storage chamber C may be minimized.

In the fifth to eighth examples of Table 1, the target temperature of the first storage chamber C exceeds the set temperature (e.g., −13° C.) and the temperature of the third storage chamber is satisfied. In this case, the controller 120 may close the damper 10 regardless of satisfaction/dissatisfaction of the temperature of the first storage chamber and satisfaction/dissatisfaction of the temperature of the second storage chamber. In addition, the controller 120 may drive the first cooling fan 56 and the second cooling fan 66 and the path switching device 110 according to satisfaction/dissatisfaction of the temperature of the first storage chamber and satisfaction/dissatisfaction of the temperature of the second storage chamber, when the temperature of the third storage chamber is satisfied.

Hereinafter, the fifth example will be described.

The controller 120 may control the path switching device 110 to the bypass mode, rotate the second cooling fan 66 at the middle speed M between the high speed H and the low speed L, and stop the first cooling fan 56, when the target temperature of the first storage chamber C exceeds the set temperature, the temperature of a third storage chamber is satisfied, the temperature of the first storage chamber is satisfied and the temperature of the second storage chamber is dissatisfied like the fifth example of Table 1.

In the path switching device 110 is in the bypass mode, the path switching device 110 may not guide refrigerant to the first storage chamber evaporator 5 and may guide refrigerant to the second storage chamber evaporator 6, and the refrigerant may bypass the first storage chamber evaporator 5 and pass through the second storage chamber evaporator 6, and eventually being sucked into the compressor 3.

Since the third storage chamber R is satisfied, the second cooling fan 66 may be driven at the middle speed M without being driven at the high speed H. Since the damper is in a close mode, the cold air of the second storage chamber F may flow to the second storage chamber evaporator 6 to exchange heat with the second storage chamber evaporator 6, thereby being concentratedly discharged in the second storage chamber F. The refrigerator may concentratedly cool the second storage chamber F.

Hereinafter, the sixth example will be described.

The controller 120 may control the path switching device 110 to the serial mode, rotate the first cooling fan 56 at the middle speed M between the high speed H and the low speed L, and stop the second cooling fan 66, when the target temperature of the first storage chamber C exceeds the set temperature, the temperature of a third storage chamber is satisfied, the temperature of the first storage chamber is dissatisfied and the temperature of the second storage chamber is satisfied like the sixth example of Table 1.

If the path switching device 110 is in the serial mode, the path switching device 110 may guide refrigerant to the first storage chamber evaporator 5, the refrigerant may pass through the first storage chamber evaporator 5 and then pass through the second storage chamber evaporator 6, and the refrigerant may be sucked into the compressor 3 after cooling the first storage chamber C and the second storage chamber F.

Since the third storage chamber R is satisfied, the first cooling fan 56 may be driven at the middle speed M without being driven at the high speed H. Since the damper is in a close mode, the cold air of the first storage chamber C may flow to the first storage chamber evaporator 5 to exchange heat with the first storage chamber evaporator 5, thereby being concentratedly discharged in the first storage chamber C. The refrigerator may concentratedly cool the first storage chamber C.

Hereinafter, the seventh example will be described.

The controller 120 may control the path switching device 110 to the serial mode and rotate the first cooling fan 56 and the second cooling fan 66 at the middle speed M between the high speed H and the low speed L, when the target temperature of the first storage chamber C exceeds the set temperature, the temperature of a third storage chamber is satisfied, the temperature of the first storage chamber is dissatisfied and the temperature of the second storage chamber is dissatisfied like the seventh example of Table 1.

The path switching device 110 may guide refrigerant to the first storage chamber evaporator 5, the refrigerant may pass through the first storage chamber evaporator 5 and then pass through the second storage chamber evaporator 6, and the refrigerant may be sucked into the compressor 3 after cooling the first storage chamber C and the second storage chamber F.

Since the third storage chamber R is satisfied, the first cooling fan 56 and the second cooling fan 66 may be driven at the middle speed M without being driven at the high speed H. Since the damper 10 is in a close mode, the cold air of the first storage chamber C may cool the first storage chamber C while being circulated in the first storage chamber evaporator 5 and the first storage chamber C, and the cold air of the second storage chamber F may cool the second storage chamber F while being circulated in the second storage chamber evaporator 6 and the second storage chamber F. In the seventh example, the cold air of the first storage chamber C and the cold air of the second storage chamber F may independently cool the first storage chamber C and the second storage chamber F.

Hereinafter, the eighth example will be described.

The controller 120 may close the path switching device 110 and stop the first cooling fan 56 and the second cooling fan 66, when the target temperature of the first storage chamber C exceeds the set temperature, the temperature of a third storage chamber is satisfied, the temperature of the first storage chamber is satisfied and the temperature of the second storage chamber is satisfied like the eighth example of Table 1.

If the temperature of the third storage chamber, the temperature of the first storage chamber and the temperature of the second storage chamber are satisfied, the first cooling fan 56 and the second cooling fan 66 may be stopped, in order to reduce power consumption.

Table 2 shows a method of controlling the first cooling fan 56, the second cooling fan 66, the path switching device 110 and the damper 10 according to satisfaction/dissatisfaction of the third storage chamber temperature, satisfaction/dissatisfaction of the first storage chamber temperature and satisfaction/dissatisfaction of the second storage chamber temperature when the target temperature of the first storage chamber C is equal to or less than the set temperature.

TABLE 2

| Example | Third storage chamber temperature | First storage chamber temperature | Second storage chamber temperature | Second cooling fan wind speed | First cooling fan wind speed | Path switching device mode | Damper mode |
|---|---|---|---|---|---|---|---|
| Ninth example | dissatisfaction | dissatisfaction | dissatisfaction | M | M | Serial mode | open |
| Tenth example | dissatisfaction | satisfaction | satisfaction | M | M | close | open |
| Eleventh example | dissatisfaction | dissatisfaction | satisfaction | L | H | Serial mode | open |
| Twelfth embodiment | dissatisfaction | satisfaction | dissatisfaction | H | L | Bypass mode | open |
| Thirteenth example | satisfaction | satisfaction | dissatisfaction | M | stop | Bypass mode | close |
| Fourteenth example | satisfaction | dissatisfaction | satisfaction | stop | M | Serial mode | close |
| Fifteenth example | satisfaction | dissatisfaction | dissatisfaction | M | M | Serial mode | close |
| Sixteenth example | satisfaction | satisfaction | satisfaction | stop | stop | close | close |

Hereinafter, the ninth example will be described.

The controller 120 may control the path switching device 110 to the serial mode and rotate the first cooling fan 56 and the second cooling fan 66 at the middle speed M, when the target temperature of the first storage chamber C is equal to or less than the set temperature, the temperature of a third storage chamber is dissatisfied, the temperature of the first storage chamber is dissatisfied and the temperature of the second storage chamber is dissatisfied like the ninth example.

The ninth example is equal to the first example except that the first cooling fan 56 and the second cooling fan 66 rotate at the middle speed M, and thus a detailed description thereof will be omitted.

If the target temperature of the first storage chamber C is equal to or less than the set temperature, the target temperature of the first storage chamber C may be equal or similar to the target temperature of the second storage chamber. In this case, since the temperature difference between the first storage chamber C and the second storage chamber F is not large, even when the first cooling fan 56 and the second cooling fan 66 rotate at the middle speed M, unbalance of cold air supply does not occur, and the third storage chamber R may be cooled as the cold air of the first storage chamber C and the cold air of the second storage chamber F are supplied to the third storage chamber R.

Hereinafter, the tenth example will be described.

The controller 120 may close the path switching device 110 and rotate the first cooling fan 56 and the second cooling fan 66 at the middle speed M, when the target temperature of the first storage chamber C is equal to or less than the set temperature, the temperature of a third storage chamber is dissatisfied, the temperature of the first storage chamber is satisfied and the temperature of the second storage chamber is satisfied like the tenth example.

The ninth example is equal to the second example except that the first cooling fan 56 and the second cooling fan 66 rotate at the middle speed M, and thus a detailed description thereof will be omitted.

In the tenth example, like the ninth example, the first cooling fan 56 and the second cooling fan 66 may rotate at the middle speed M, and the third storage chamber R may be cooled as the cold air of the first storage chamber C and the cold air of the second storage chamber F are supplied to the third storage chamber R.

The eleventh to sixteenth examples shown in Table 2 may perform the same control processes as the third to eighth examples shown in Table 1 regardless of the target temperature of the first storage chamber C. That is, the eleventh example may perform the same control process as the third example even when the target temperature of the first storage chamber C is equal to or less than the set temperature, the twelfth example may perform the same control process as the fourth example even when the target temperature of the first storage chamber C is equal to or less than the set temperature, the thirteenth example may perform the same control process as the fifth example even when the target temperature of the first storage chamber C is equal to or less than the set temperature, the fourteenth example may perform the same control process as the sixth example even when the target temperature of the first storage chamber C is equal to or less than the set temperature, the fifth example may perform the same control process as the seventh example even when the target temperature of the first storage chamber C is equal to or less than the set temperature, and the sixteen example may perform the same control process as the eighth example even when the target temperature of the first storage chamber C is equal to or less than the set temperature.

It is possible to more rapidly cool the third storage chamber while minimizing back flow of cold air between the second storage chamber and the first storage chamber generated when a difference between the target temperature of the second storage chamber and the target temperature of the first storage chamber C is large.

Figure 7:
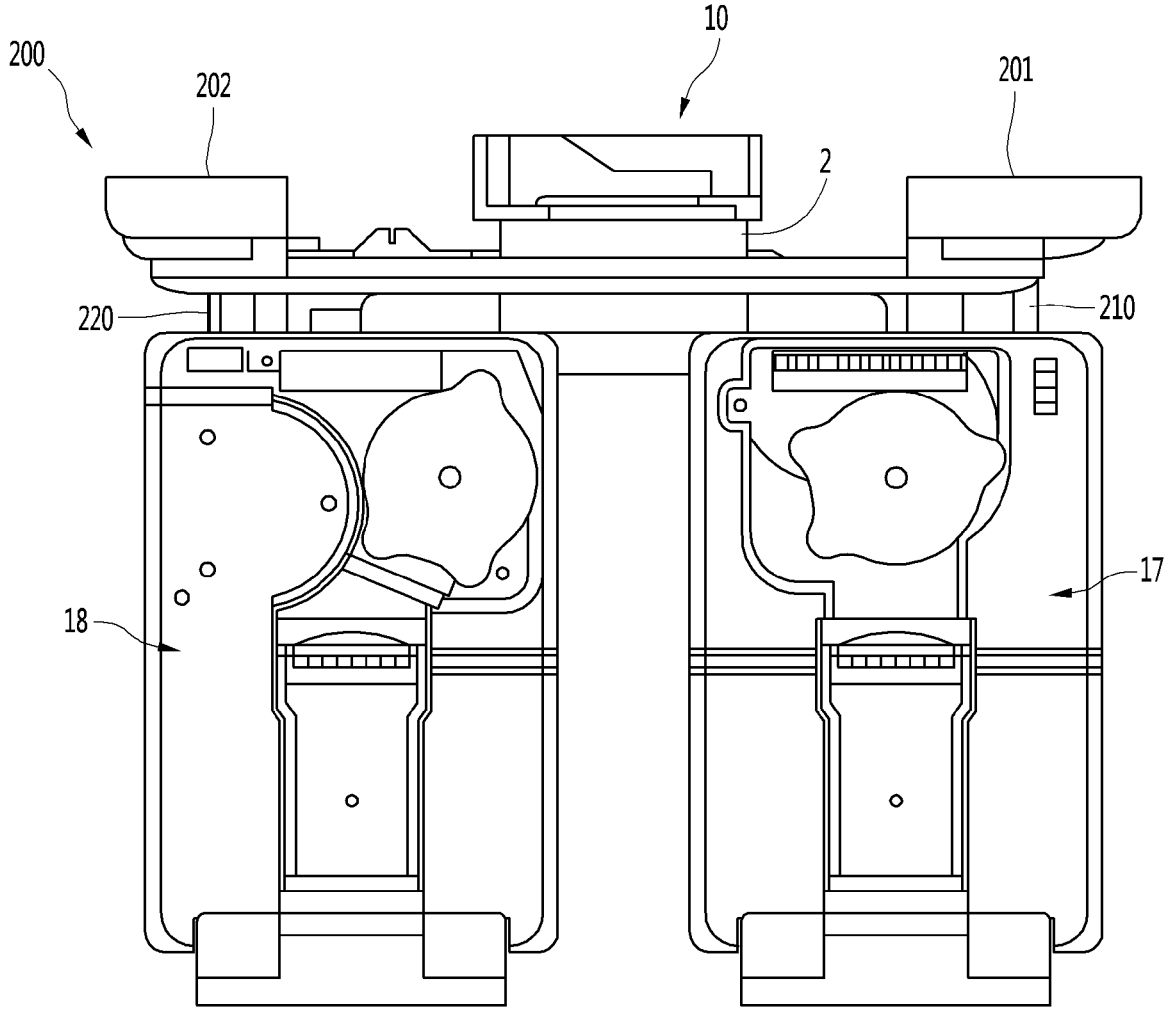
FIG. 7 is a front view showing a first discharging duct, a second discharging duct, a duct, a damper, an inlet duct and a return duct according to the embodiment of the present disclosure.
Figure 8:
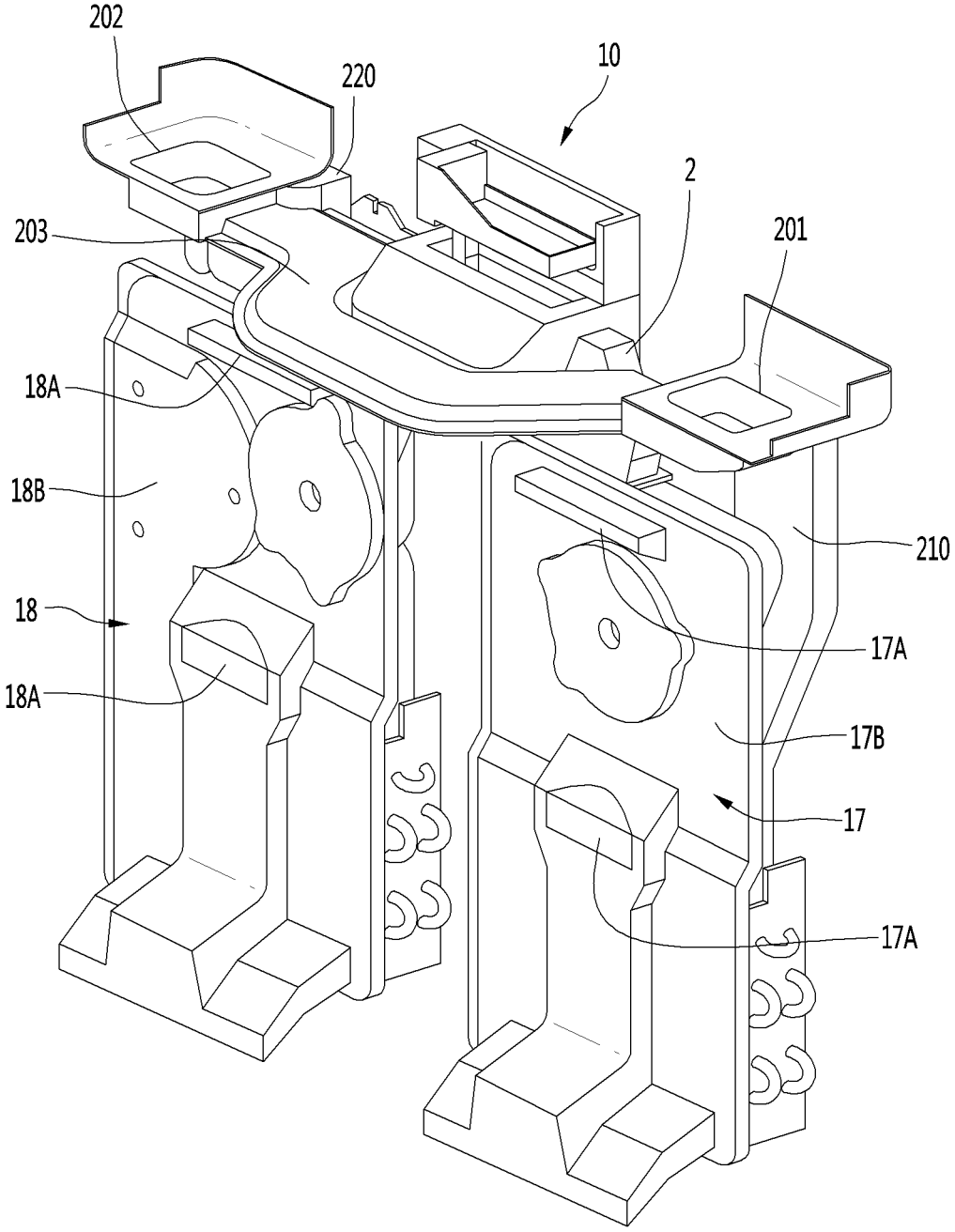
FIG. 8 is a perspective view showing the first discharging duct, the second discharging duct, the duct, the damper, the inlet duct and the return duct according to the embodiment of the present disclosure.
Figure 9:
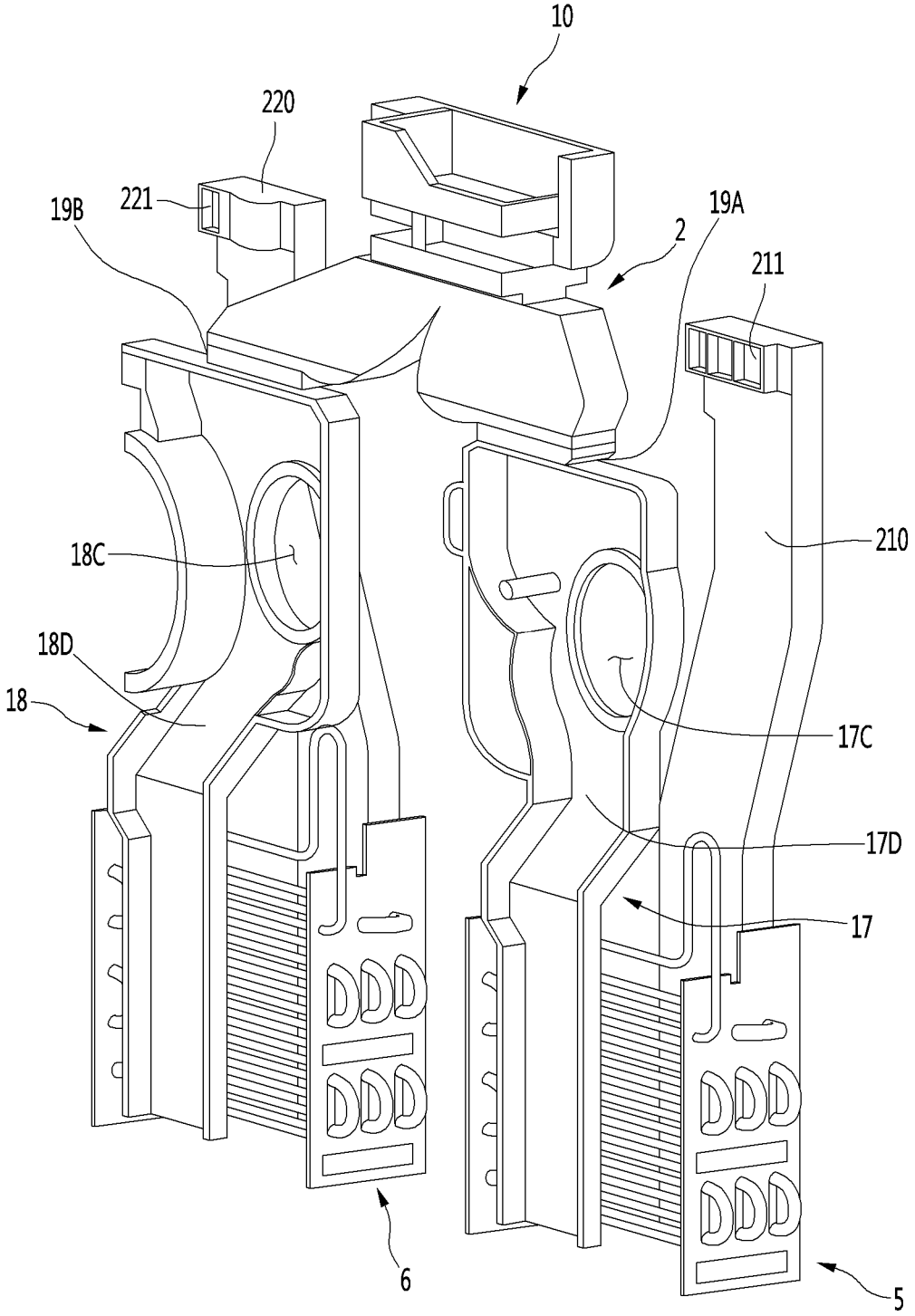
FIG. 9 is a perspective view of the case where a discharging cover and the inlet duct shown in FIG. 8 are separated.

FIG. 7 is a front view showing a first discharging duct 17, a second discharging duct 18, a duct 2, a damper 10, an inlet duct 200 including a first inlet 201 and a second inlet 202, a first return duct 210 and a second return duct 220 according to the embodiment of the present disclosure, FIG. 8 is a perspective view showing the first discharging duct 17, the second discharging duct 18, the duct 2, the damper 10, the first inlet 201, the second inlet 202, the first return duct 210 and the second return duct 220 according to the embodiment of the present disclosure, and FIG. 9 is a perspective view of the case where a discharging cover and an inlet duct shown in FIG. 8 are separated.

The refrigerator may further include the inlet duct 200, the first return duct 210 and the second return duct 220.

In the inlet duct 200, the first inlet 201 and the second inlet 202 for sucking the cold air of the third inner case 15 may be formed. The first inlet 201 and the second inlet 202 may be spaced apart from each other. The first inlet 201 and the second inlet 202 may be spaced apart from each other in a horizontal direction with at least one of the duct 2 and the damper 10 interposed therebetween.

The first inlet 201 and the second inlet 202 may be disposed below the third inner case 15.

One of the first inlet 201 and the second inlet 202 may be disposed closer to a left plate of the third inner case 15 than a right plate of the third inner case 15, and the other of the first inlet 201 and the second inlet 202 may be disposed closer to the right plate than the left plate. In this case, the cold air of the lower portion of the third storage chamber R may be distributed and sucked into the first inlet 201 and the second inlet 202.

The inlet duct 200 may further include an inlet communication portion 203 for enabling the first inlet 201 and the second inlet 202 to communicate with each other.

A left side of the inlet communication portion 203 may communicate with the first inlet 201 and a right side of the inlet communication portion 203 may communicate with the second inlet 202.

The inlet communication unit 203 may be bent at least once. A central portion of the inlet communication unit 203 may be located in front of at least one of the duct 2 and the damper 10 and the left and right portions thereof may be partially curved or bent inward.

The first return duct 210 may be connected to the first inlet 201 or the inlet communication unit 203 of the inlet duct 200 to guide the cold air of the inlet duct 200 to the first evaporator 5. A first suction port 211 connected to the first inlet 201 or the inlet communication unit 203 of the inlet duct 200 may be formed in an upper portion of the first return duct 210.

The first return duct 210 may extend in the vertical direction and a lower portion thereof may extend to a rear side of the first evaporator 5. A first discharging duct 17 for guiding the air passing through the inlet duct 200 to the lower portion of the first evaporator 5 may be formed in the first return duct 210.

The second return duct 220 may be connected to the second inlet 202 or the inlet communication unit 203 of the inlet duct 200 to guide the cold air of the inlet duct 200 to the second evaporator 6. A second suction port 221 connected to the second inlet 202 or the inlet communication unit 203 of the inlet duct 200 may be formed in an upper portion of the second return duct 220. The second return duct 220 may extend in the vertical direction and a lower portion thereof may extend to a rear side of the second evaporator 6. A second discharging duct 18 for guiding the air passing through the inlet duct 200 to the lower portion of the second evaporator 6 may be formed in the second return duct 220.

The first discharging duct 17 may be composed of a combination of a plurality of members and an inner passage for guiding air blown from the first cooling fan 56 may be formed therein.

The first discharging duct 17 may include a first front discharging cover 17B having a larger size than the first evaporator 5 to cover the first evaporator 5 and having formed therein one or more cold air discharging holes 17A for discharging cold air to the first storage chamber C, and a first rear duct 17D disposed on a rear surface of the first front discharging cover 17B, having formed therein a through-hole 17*c*, through which air blown from the first cooling fan 56 passes, and guiding air to the one or more cold air discharging holes 17A.

A first duct connector 19A connected with the duct 2 may be formed on an upper portion of at least one of the first front discharging cover 17B and the first rear duct 17D.

The second discharging duct 18 may include a second front discharging cover 18B having a larger size than the second evaporator 6 to cover the second evaporator 6 and having formed therein one or more cold air discharging holes 18A for discharging cold air to the second storage chamber F, and a second rear duct 18D disposed on the rear surface of the second front discharging cover 18B, having formed therein a through-hole 18*c*, through which air blown from the second cooling fan 66 passes, and guiding air to the one or more cold air discharging holes 18A.

A second duct connector 19B connected with the duct 2 may be formed on an upper portion of at least one of the second front discharging cover 18B and the second rear duct 18D.

Figure 10:
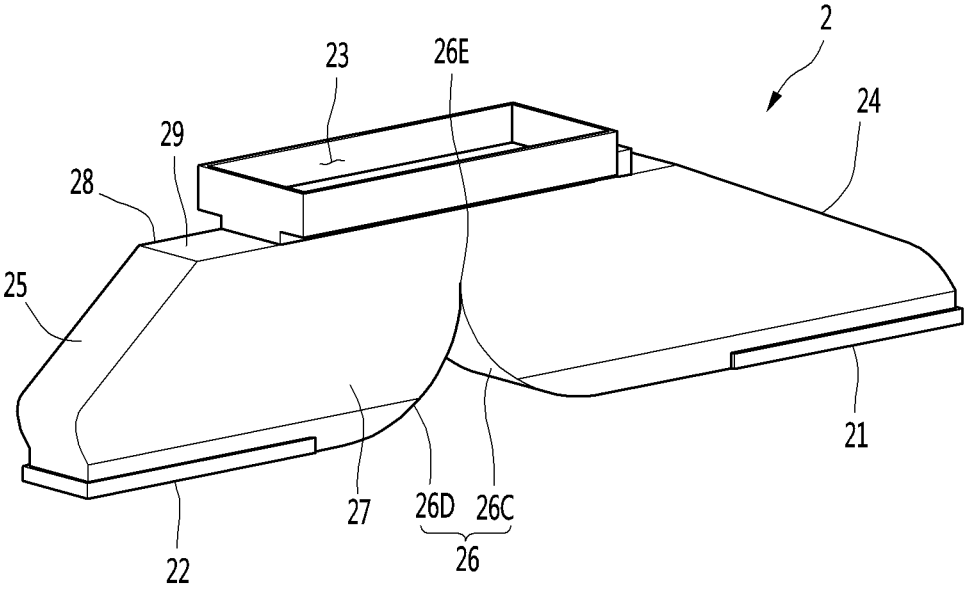
FIG. 10 is a perspective view of the duct of the refrigerator according to the embodiment of the present disclosure.
Figure 11:
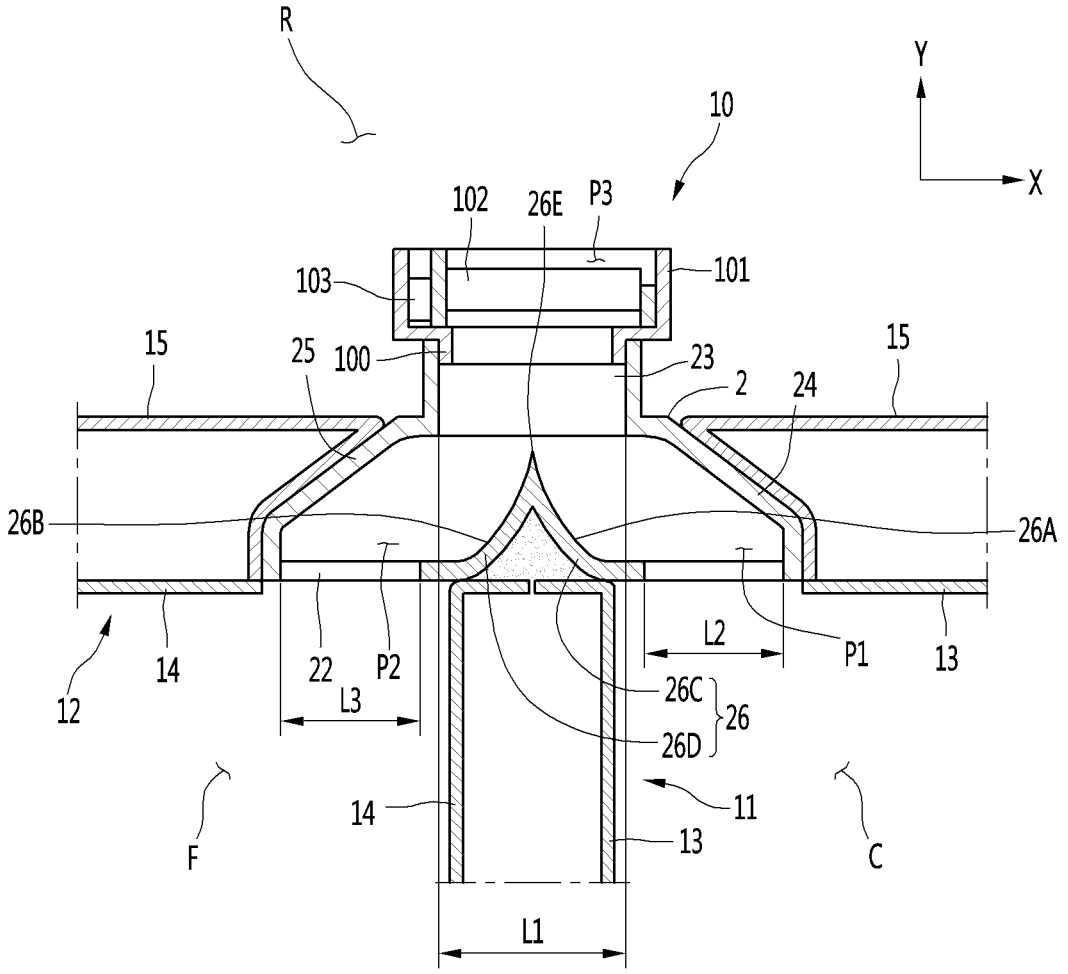
FIG. 11 is a view showing the duct and the damper when the damper of the refrigerator according to the embodiment of the present disclosure is opened.
Figure 12:
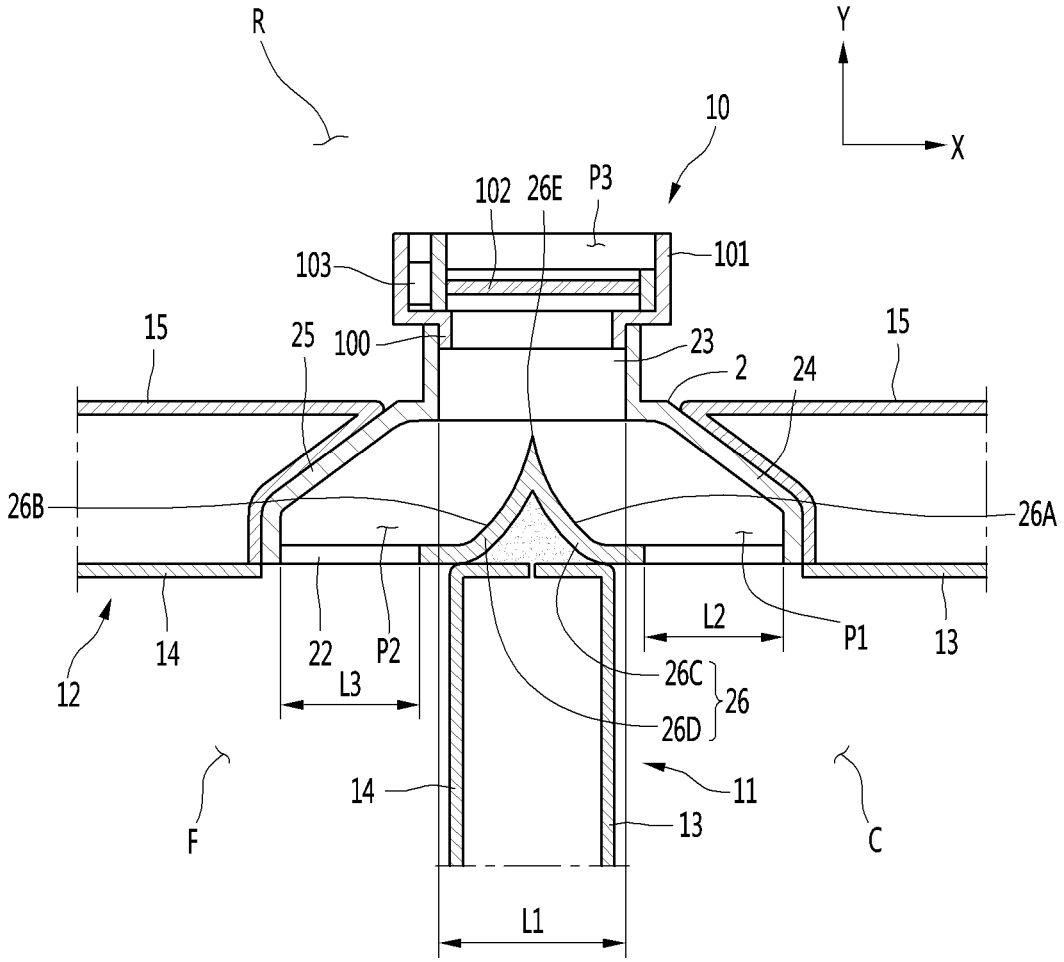
FIG. 12 is a view showing the duct and the damper when the damper of the refrigerator according to the embodiment of the present disclosure is closed.

FIG. 10 is a perspective view of the duct of the refrigerator according to the embodiment of the present disclosure, FIG. 11 is a view showing the duct and the damper when the damper of the refrigerator according to the embodiment of the present disclosure is opened, and FIG. 12 is a view showing the duct and the damper when the damper of the refrigerator according to the embodiment of the present disclosure is closed.

In the duct 2, a first inlet portion 21 communicating with the inside of the first inner case 13, a second inlet portion 22 communicating with the inside of the second inner case 14 and an outlet portion 23 communicating with the inside of the third inner case 15 may be formed.

In the duct 2, a first conduit P1 for guiding, to the outlet portion 23, the cold air flowing from the first cooling fan 56 to the first inlet portion 21, and a second conduit P2 for guiding, to the outlet port 23, the cold air flowing from the second cooling fan 66 to the second inlet portion 22 may be formed. The first conduit P1 and the second conduit P2 may be joined inside the duct 2. The first conduit P1 and the second conduit P2 may be joined to communicate with each other at an upstream side of the outlet portion 23 in the air flow direction or at the outlet portion 23.

The first inlet portion 21 may be connected to the upper portion of the first discharging duct 17, as shown in FIGS. 8 and 9.

The second inlet portion 22 may be connected to the upper portion of the second discharging duct 18, as shown in FIGS. 8 and 9.

The outlet portion 23 may not overlap with the first inlet portion 21 and the second inlet portion 22 in the vertical direction Y and the horizontal direction X.

The duct 2 may include a first guide 24, a second guide 25 and a barrier 26.

The duct 2 may further include a front cover 27 connecting the front ends of the first guide 24, the second guide 25 and the barrier 26, a rear cover 28 connecting the rear ends of the first guide 24, the second guide 25 and the barrier 26, and a top cover 29 connecting the upper end of the front cover 27 and the rear cover 28 and having the outlet portion 23 formed therein.

The first guide 24 and the second guide 25 may be spaced apart from each other.

The barrier 26 may be located between the first guide 24 and the second guide 25 and may be spaced apart from the first guide 24 and the second guide 25.

Both surfaces 26A and 26B of the barrier 26 may be air guide surfaces for guiding cold air to the outlet portion 23. Both surfaces 26A and 26B of the barrier 26 may be recessed.

It is possible to maximally guide the cold air blown from the first cooling fan 56 and the second cooling fan 66 in the vertical direction and to minimize flow of the cold air between the first storage chamber C and the second storage chamber F.

The first conduit P1 may be formed between one surface 26A of the barrier 26 and the first guide 24.

The second conduit P2 may be formed between the other surface 26B of the barrier 26 and the second guide 25.

The duct 2 may determine the amount of cold air flowing between the first storage chamber C and the second storage chamber F according to a height and shape of the barrier 26. The duct 2 may have a height and shape such that the amount of cold air flowing between the first storage chamber C and the second storage chamber F is not excessively large and may have a shape and height such that each of cold air flowing in the first storage chamber C and cold air flowing in the second storage chamber F is directed to the damper 10 as much as possible.

One surface of the barrier 26 and the other surface of the barrier 26 may be sloped gradually from the bottom and become steep toward the top.

The barrier 26 may include a left wall 26C and a right wall 26D.

The left wall 26C may include one surface 26A of the barrier 26 and may be spaced apart from the first guide 24 in the horizontal direction X.

The right wall 26D may include the other surface 26B of the barrier 26 and may be spaced apart from the second guide 25 in the horizontal direction X.

The left wall 26C and the right wall 26D may be connected at an upper end 26E. The upper end 26E of the barrier 26 may face a bottom surface of the damper 10.

If the height of the barrier 26 is too high, a possibility of interference between the barrier 26 and the damper 10 may be great, and, if the height of the barrier 26 is too low, the amount of cold air flowing between the first storage chamber R and the second storage chamber C may be excessively large.

The barrier 26 may be spaced apart from the outlet portion 23 and under the outlet portion 23 in the vertical direction Y.

The upper end 26E of the barrier 26 may be closer to the outlet portion 23 than the first inlet portion 21 and the second inlet portion 22.

Lower ends of the left wall 26C and the right wall 26D may not be connected to each other, and the left wall 26C and the right wall 26D may progressively move away from each other in the vertical direction Y toward the bottom. An insulator may be filled between the left wall 26C and the right wall 26D.

A left-and-right length L1 (in the horizontal direction X) of the outlet portion 23 may be greater than a left-and-right length L2 of the first inlet portion 21 and a left-and-right length L2 of the second inlet portion 22.

The damper 10 may communicate with the outlet portion 23. The damper 10 may control flow of cold air through the duct 2.

The damper 10 may be disposed above the duct 2. A duct communication portion 100 inserted into the outlet portion 23 may be formed on a lower portion of the damper 10.

The damper 10 may include a path body 101 in which a passage P3, through which air passes, is formed, a damper body 102 for opening or closing the passage P3 of the path body 101, and a driving device 103 connected to the damper body 102 directly or through at least one power transmission member to open or close the damper body 102, such as a motor.

The path body 101 may be connected to the duct 2, the damper body 102 may be rotatably disposed in the path body 101, and the driving device 103, such as the motor, may be mounted at the path body 101 to rotate the damper body 102.

In the open mode of the damper 10, as shown in FIG. 11, the damper body 102 may rotate in a direction for opening the passage P3, and the cold air of the first storage chamber and/or the cold air of the second storage chamber F may flow to the first storage chamber R through the duct 2.

In the open mode of the damper 10, the cold air of the first storage chamber C may flow into the first inlet portion 21, pass through the first passage P1, and then pass through the damper 10, and the cold air of the second storage chamber F may flow into the second inlet portion 22, pass through the second passage P2, and then pass through the damper 10.

In the close mode of the damper 10, as shown in FIG. 12, the damper body 102 may rotate in a direction for closing the passage of the passage P3, and the cold air of the first storage chamber C and the cold air of the second storage chamber F are blocked by the damper 10 as not to flow to the third storage chamber R.

The damper 10 may control the opening area of the passage P3 in multiple stages. In this case, the flow rate of cold air flowing from one of the first storage chamber C and the second storage chamber F to the third storage chamber R may be more precisely controlled.

According to the embodiments of the present invention, cold air of the first inner case is guided into the third inner case and/or the cold air of the second inner case is guided into the third inner case using one duct and one damper, thereby simplifying a structure and minimizing the number of parts.

In addition, since the inside of the third inner case may be cooled without the evaporator or the cooling fan inside the third inner case, it is possible to maximize the effective volume of the third storage chamber formed in the third inner case.

The above-disclosed subject matter is to be considered illustrative, and not restrictive, and the appended claims are intended to cover all such modifications, enhancements, and other embodiments, which fall within the scope of the present disclosure.

Thus, the embodiment of the present disclosure is to be considered illustrative, and not restrictive.

Therefore, the scope of the appended claims is defined not by the detailed description of the invention but by the appended claims, and all differences within the scope will be construed as being included in the appended claims.

What is claimed is:

1. A refrigerator comprising:

a compressor and a condenser;

a first inner case in which a first storage chamber is formed;

a second inner case disposed next to the first inner case and in which a second storage chamber is formed;

a third inner case having a larger size than the first inner case and the second inner case;

a first evaporator and a first cooling fan disposed inside the first inner case;

a second evaporator and a second cooling fan disposed inside the second inner case;

a four-way valve connected to an outlet of the condenser and configured to switch a path of a refrigerant condensed in the condenser;

a pair of main capillary tubes connected to the four-way valve, the pair of main capillary tubes being connected to the first evaporator;

a bypass capillary tube connected to the four-way valve;

an evaporator connection path configured to connect the first evaporator with the second evaporator;

a bypass path connected to the evaporator connection path and the bypass capillary tube to allow the refrigerant to bypass the first evaporator, a duct including a first inlet portion communicating with an inside of the first inner case, a second inlet portion communicating with an inside of the second inner case, an outlet portion communicating with the third inner case, a first conduit for guiding, to the outlet portion, air blown from the first cooling fan from the first inlet portion, and a second conduit for guiding, to the outlet portion, air blown from the second cooling fan from the second inlet portion are formed; and a damper communicating with the outlet portion, wherein when the damper is opened, air of the first storage chamber and/or air of the second storage chamber flows to the third storage chamber through the duct.

2. The refrigerator of claim 1, wherein the duct includes:

a first guide and a second guide spaced apart from each other; and a barrier located between the first guide and the second guide and spaced apart from the first guide and the second guide, wherein the first conduit is formed between one surface of the barrier and the first guide, and wherein the second conduit is formed between an other surface of the barrier and the second guide.

3. The refrigerator of claim 2, wherein the barrier includes:

a left wall spaced apart from the first guide in a horizontal direction; and a right wall spaced apart from the second guide in the horizontal direction, and wherein the left wall and the right wall are connected at an upper end.

4. The refrigerator of claim 3, wherein the left wall and the right wall of the barrier progressively move away from each other in a vertical direction toward a bottom.

5. The refrigerator of claim 2, wherein the barrier is spaced apart from the outlet portion and under the outlet portion in a vertical direction.

6. The refrigerator of claim 2, wherein one surface of the barrier and an other surface of the barrier become sloped gradually from a bottom and become steep toward a top of the barrier.

7. The refrigerator of claim 2, wherein an upper end of the barrier is closer to the outlet portion than the first inlet portion and the second inlet portion of the duct.

8. The refrigerator of claim 1, wherein the outlet portion does not overlap with the first inlet portion and the second inlet portion in a vertical direction and a horizontal direction.

9. The refrigerator of claim 1, wherein a left-and-right length of the outlet portion is greater than a left-and-right length of the first inlet portion and a left-and-right length of the second inlet portion.

10. The refrigerator of claim 1, wherein a duct communication portion inserted into the outlet portion is formed in the damper.

11. The refrigerator of claim 1, further comprising:

an inlet duct including a first inlet and a second inlet for sucking air of the third inner case, the first inlet and the second inlet being spaced apart from each other;

a first return duct connected to the first inlet to guide air of the inlet duct to the first evaporator; and a second return duct connected to the second inlet to guide air of the inlet duct to the second evaporator.

12. The refrigerator of claim 1, wherein the first inlet portion and the second inlet portion are spaced apart from each other in a horizontal direction with at least one of the duct and the damper interposed therebetween.

13. The refrigerator of claim 12, wherein the inlet duct further includes an inlet communication portion for enabling the first inlet and the second inlet to communicate with each other.

14. The refrigerator of claim 11, wherein the first return duct extends in a vertical direction and a lower portion of the first return duct extends to a rear side of the first evaporator; and the second return duct extends in the vertical direction and a lower portion of the second return duct extends to a rear side of the second evaporator.

15. The refrigerator of claim 1, further comprising:

a first discharging duct disposed inside the first inner case to cover the first evaporator;

a second discharging duct disposed inside the second inner case to cover the second evaporator, wherein the first inlet portion is connected to an upper portion of the first discharging duct, and the second inlet portion is connected to an upper portion of the second discharging duct.

16. The refrigerator of claim 15, wherein the first discharging duct includes a first front discharging cover having a larger size than the first evaporator to cover the first evaporator, and the second discharging duct includes a second front discharging cover having a larger size than the second evaporator to cover the second evaporator.

17. The refrigerator of claim 16, wherein the first front discharging cover includes one or more air discharging holes to discharge air to the first inner case, and the second front discharging cover includes one or more air discharging holes to discharge air to the second inner case.

18. The refrigerator of claim 17, wherein the first discharging duct includes a first rear duct disposed on a rear surface of the first front discharging cover, and the second discharging duct includes a second rear duct disposed on a rear surface of the second front discharging cover.

19. The refrigerator of claim 18, wherein the first rear duct includes a through hole through which air blown from the first cooling fan passes through, and the second rear duct includes a through hole through which air blown from the second cooling fan passes through.

20. The refrigerator of claim 1, wherein the damper includes a path body having a passage through which the air passes through, and a damper body rotatably disposed in the path body, wherein the damper body rotates to open and close the passage.

21. A refrigerator comprising:

a first inner case;

a second inner case disposed next to the first inner case;

a third inner case having a larger size than the first inner case and the second inner case;

a first evaporator and a first cooling fan disposed inside the first inner case;

a second evaporator and a second cooling fan disposed inside the second inner case;

a duct including a first inlet portion communicating with an inside of the first inner case, a second inlet portion communicating with an inside of the second inner case, an outlet portion communicating with the third inner case, a first conduit for guiding, to the outlet portion, air blown from the first cooling fan from the first inlet portion, and a second conduit for guiding, to the outlet portion, air blown from the second cooling fan from the second inlet portion are formed;

a damper communicating with the outlet portion;

an inlet duct including a first port and a second port for sucking air of the third inner case, the first inlet and the second inlet being spaced apart from each other;

a first return duct connected to the first port to guide air of the inlet duct to the first evaporator; and a second return duct connected to the second port to guide air of the inlet duct to the second evaporator, wherein the first return duct extends downward from the inlet duct and a lower portion of the first return duct extends to a rear side of the first evaporator; and the second return duct extends downward from the inlet duct and a lower portion of the second return duct extends to a rear side of the second evaporator, and wherein at least one of the duct and the damper is disposed between the first port and the second port.

22. The refrigerator of claim 21, wherein the first port and the second port are disposed at a bottom of the third inner case, the first port and the second port are disposed at a closer to a first side wall of the third inner case than a second side wall of the third inner case.

23. The refrigerator of claim 21, further comprising:

an inlet communicating portion configured to connect the first and the second ports, wherein a center of the inlet communicating portion is disposed in front of the duct and the damper.

* * * * *